United States Patent [19]

Strada

[11] 4,099,627

[45] Jul. 11, 1978

[54] ARRANGEMENT FOR DISPLAYING ARTICLES

[75] Inventor: Robert Strada, New York, N.Y.

[73] Assignee: Robert Strada Design Associates, Inc., New York, N.Y.

[21] Appl. No.: 725,273

[22] Filed: Sep. 21, 1976

[51] Int. Cl.[2] ..... A47F 3/10

[52] U.S. Cl. ..... 211/163; 211/188; 211/194

[58] Field of Search ..... 211/4, 7, 70, 77, 78, 211/126, 128, 129, 131, 144, 163, 188, 194; 108/93, 91, 92; 206/505, 507; 248/DIG. 2, 131

[56] References Cited

U.S. PATENT DOCUMENTS

| | | | |
|---|---|---|---|
| 1,979,911 | 11/1934 | Steudel | 108/91 |
| 3,094,951 | 6/1963 | Levinson | 211/188 X |
| 3,543,943 | 12/1970 | Joy et al. | 211/131 |
| 3,674,156 | 7/1972 | Krebs | 211/4 |
| 3,883,037 | 5/1975 | Seiller | 206/507 X |

FOREIGN PATENT DOCUMENTS

| | | | |
|---|---|---|---|
| 4,751 of | 1928 | Australia | 211/128 |

*Primary Examiner*—Roy D. Frazier
*Assistant Examiner*—Terrell P. Lewis
*Attorney, Agent, or Firm*—Michael J. Striker

[57] ABSTRACT

An arrangement for displaying articles utilizes a plurality of elements which are stackable and nestable in a row. Each element has a projection at one side thereof which extends lengthwise of the row. Each projection has free end portions which are elongated transversely of the row in a first direction. For stacking purposes, each element has a recess formed at the other side thereof which is also elongated transversely of the row but in a different second direction. Each recess of a respective element is operative for stackably receiving a projection of another element upon alignment of the respective free end portions in the second direction. Successively stacked elements are maintained at a predetermined spacing from each other by virtue of the fact that each recess has a depth such as to receive only a fractional part of the respective projection. For nesting purposes, each element has a cavity formed at the other side thereof which is elongated in the first direction. Each cavity is adapted to nestably receive a respective projection upon mutual alignment. Successively nested elements are mounted at a distance which is relatively smaller than the aforementioned predetermined spacing by virtue of the fact that each cavity has a larger depth as compared with the depth of each recess. The arrangement may also include turnable supports for fixedly mounting one of the elements.

10 Claims, 3 Drawing Figures

ARRANGEMENT FOR DISPLAYING ARTICLES

BACKGROUND OF THE INVENTION

The present invention relates to an arrangement for displaying articles. More particularly, the invention relates to an arrangement which utilizes a plurality of elements each of which is stackable in a row and is configurated so as to receive articles to be displayed. Still more particularly, the plurality of elements are adapted to be nested in a row.

Various types of article-displaying arrangements are known for merchandising applications. For example, it is known to fixedly mount plates at predetermined locations lengthwise along an upright pole. Articles to be displayed are placed on the upper side of each plate so that the articles may be viewed by an observer.

However, such arrangements have not proven altogether satisfactory inasmuch as the assembling and disassembling of the plurality of plates on the pole is a very time-consuming and costly procedure. Furthermore, the arrangement is rather cumbersome and occupies a large amount of space — an aspect which is very undesirable for shipping purposes. Another drawback of the fixed mounting prior-art arrangements is that a viewer must walk around the plates in order to observe all of the articles mounted thereon.

SUMMARY OF THE INVENTION

Accordingly, it is general object of the present invention to overcome the drawbacks of the prior art.

Another object of the present invention is to reduce the time involved for assembling and disassembling an article-displaying arrangement.

An additional object of the present invention is to simplify the assembling and disassembling of an article-displaying arrangement by providing successive elements with the feature that they be stackable with respect to each other.

Yet another feature of the present invention is to facilitate shipping of an article-displaying arrangement by providing successive elements with the feature that they be nestable with respect to each other.

Another object of the present invention is to maximize the effective display area for a viewer.

Still another object of the present invention is to provide a simple and inexpensive arrangement which can be used for displaying articles.

In keeping with these objects and others which will become apparent hereinafter, the invention resides, briefly stated, in an arrangement which comprises a plurality of elements which are both stackable and nestable in a row. Each elements has a projection at one side thereof which extends lengthwise of the row; and each projection has free end portions which are elongated transversely of the row in a first direction. In accordance with the stacking feature of the invention, each element has a recess formed at the other side thereof which is also elongated transversely of the row but in a different second direction. Each recess of a respective element is operative for stackably receiving a projection of another element upon alignment of the respective free end portions in the second direction. Successively-stacked elements are maintained at a predetermined spacing from each other by virtue of the fact that each recess has a depth such as to receive only a small fractional part of the respective projection.

In accordance with the nesting feature of the invention, each element has a cavity formed at the other side thereof which is elongated in the first direction. Each cavity is adapted to nestably receive a respective projection upon mutual alignment. Successively-nested elements are mounted at a distance which is relatively smaller than the aforementioned predetermined spacing by virtue of the fact that each cavity has a larger depth as compared with the depth of each recess.

The stacking feature of the invention greatly reduces the assembly and/or disassembly times generally encountered in prior-art arrangements. By increasing the number of elements, the arrangement can be built as long as desired. For shipping purposes, the reception of the projection almost entirely within a respective cavity assures that a minimum amount of space will be utilized.

In accordance with yet another feature of the invention, the free end portions of a projection may be provided with a shoulder for abutment with a complementary shoulder provided in a recess of the respective other side of another element. This feature increases the relative stability of the entire arrangement and serves to prevent tipping or leaning over of the arrangement, a feature which is of particular advantage when many such elements are to be stacked.

Still another feature of the invention is embodied in providing holes in both the projections and the recesses at respective locations such that respective ones of the holes are juxtaposed with each other upon insertion of a projection into a recess. Reinforcing pins may thereupon be inserted through the juxtaposed holes in order to still further increase the relative stability of the stacked arrangement.

An additional feature of the invention provides a mounting aperture on each element which is adapted to receive an elongated support or pole. An element may be fixedly mounted on the support, and thereupon successive elements may be stacked in the manner described above onto the fixed element. Furthermore, the support may be mounted on a base for rotation relative thereto so as to facilitate viewing by an observer.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
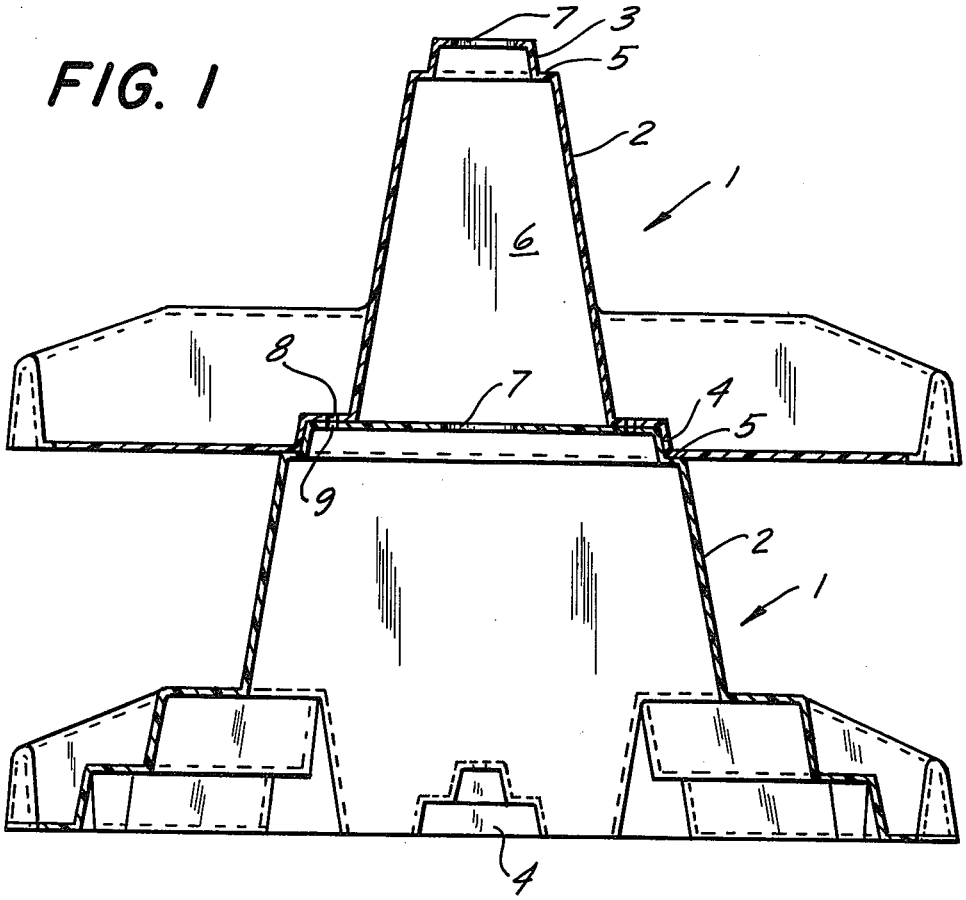
FIG. 1 is a view in cross-section of the arrangement in stacked condition.
Figure 2:
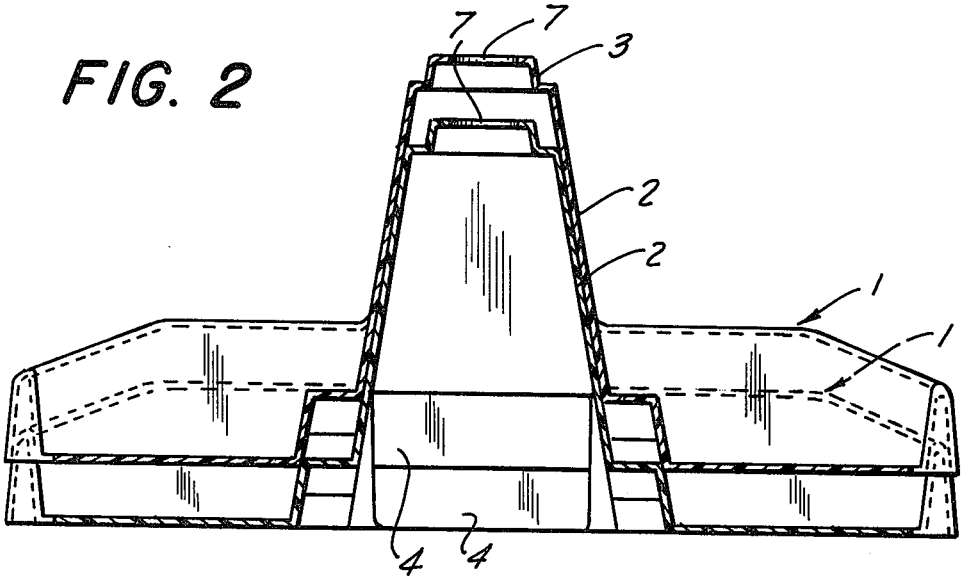
FIG. 2 is a view in cross-section of the arrangement in nested condition.

Discussing the article-displaying arrangement initially with respect to FIGS. 1 and 2, it will be seen that reference numeral 1 identifies the elements which are to be either stacked or nested in a row. Each element 1 has a projection 2 which extends generally in direction lengthwise of the row beyond one of the sides of the element. For example, the projection 2 extends upwardly beyond the upper side of each element.

Figure 3:
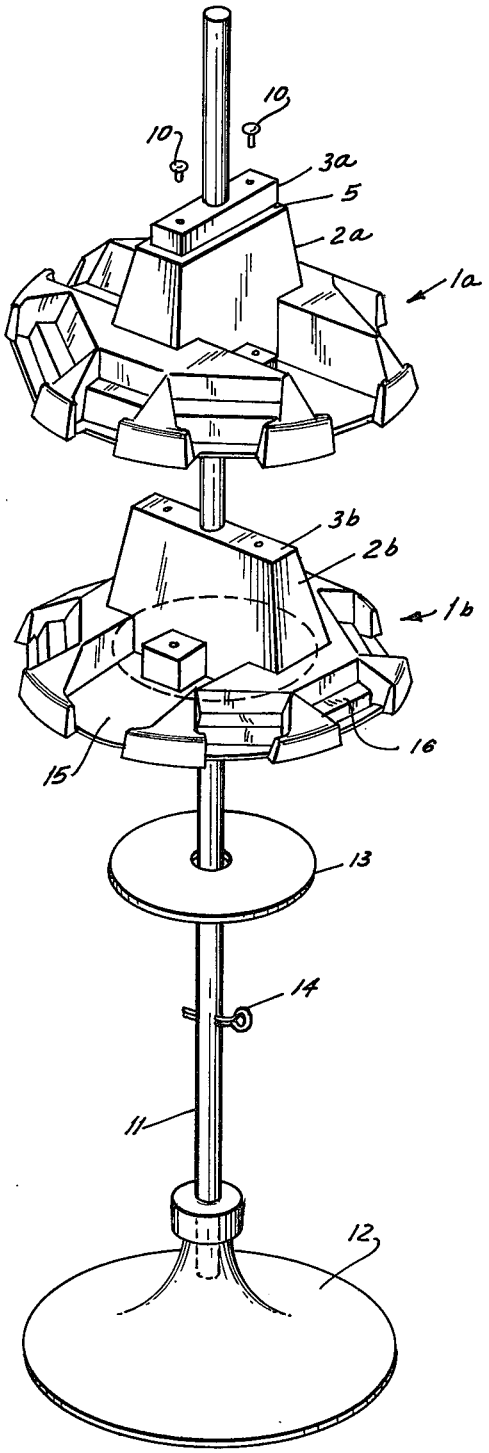
FIG. 3 is an exploded perspective view of the arrangement in accordance with another aspect of the invention.

In addition, each projection 2 has free end portions 3 which are elongated transversely of the row in a first direction. These free end portions 3 may have many different configurations. For example, in FIG. 3, the upper element 1*a* has a projection 2*a* whose free end portions 3*a* have an abutment shoulder 5. The lower element 1*b* has a projection 2*b* whose free end portions 3*b* is not formed with any such shoulder at all. Other configurations for the free end portions 3 are possible without departing in any way from the spirit of the invention.

In accordance with the stacking feature of the invention, each element 1 is formed with a recess 4 in the other side of the element, e.g. the lower side thereof. The recess 4 is elongated transversely of the row in a different second direction so that, when the free end portions 3 of a respective other element are aligned in this second direction, the recess 4 of another element can receive these free end portions. The successive elements are thereby stacked one above another by alternately turning or aligning the next element to be stacked into its proper orientation.

Each projection 2 preferably has a generally truncated pyramidal configuration; and each corresponding recess 4 has a complementary contour. As shown in FIG. 1, each recess 4 has a depth which receives only a small fractional part of the respective projection, i.e. the recess receives only the upper free end portions 3 of the projection 2. It will be seen that the embodiment of FIG. 1 shows the abutment shoulder 5 in abutment with the lower side of the upper element 1. It should be noted that for the alternative embodiment which has no such shoulder, the recess 4 receives the free end portions 3 in frictional or wedge-type engagement due in part to the resilient nature of the walls of each element. Such resiliency is present by virtue of the material selected for the element itself, for example resilient synthetic plastic material may be used.

In accordance with the nesting feature of the invention, the other side of each element is also formed with a cavity 6 within each projection 2. The cavity 6 is elongated transversely of the row in the aforementioned first direction so that each cavity 6 of a respective element is operative for receiving a respective projection upon mutual alignment and subsequent insertion of the projection into the cavity.

FIG. 2 shows successively nested elements. It will be noted that each cavity 6 has a depth such as to receive a major fractional part of the respective projection. The depth of each cavity is relatively greater than the depth of each recess, thus successively nested elements are maintained at a relatively smaller distance with respect to each other as compared with successively stacked elements. Compare FIGS. 1 and 2.

With respect to FIG. 1, each element has a plurality of through holes 8, 9. First holes 9 are provided on the projection 2; second holes 8 are provided in the recess 4. In the stacked condition, holes 8 and 9 are juxtaposed. If desired, reinforcing pins 10 are insertable through the respectively juxtaposed holes 8, 9 fo maintaining the elements 1 in their stacked orientation with a higher degree of stability.

In accordance with another feature, a mounting aperture 7 is provided and also extends through each projection 2. The aperture 7 is operative for receiving an elongated support, such as shaft 11 which is turnably mounted on base 12 for rotation relative thereto. Thus, the individual elements 1 may be stacked one above another without the aid of any support shaft, or they may be stacked with the aid of a turnable shaft.

In the latter case, a plate 13 is fixedly mounted on shaft 11 by any conventional means, such as cotter pin 14. The plate 13 engages the underside of element 1*b*, preferably the plate 13 is received in a depression formed in the underside of the element 1*b*. After the first element 1*b* has been fixedly mounted on the shaft 11, additional elements such as 1*a* can be successively stacked in the manner described above.

Each element is provided with means for mounting the articles to be displayed thereon. For example, the articles may be mounted in pockets 15 and/or 16 which are spaced from each other in circumferential direction about the periphery of each element. Evidently, these pockets 15, 16 may have other configurations than those shown depending of course upon the size and shape of the articles to be displayed. Of course, each element may similarly have other configurations than the illustrated generally annular shape.

Each element may be constituted of any shape-holding material, such as metals and/or synthetic plastic materials, preferably high-impact, injection-molded styrene, just to mention a few possibilities. It is preferable if the elements are formed by vacuum techniques, for example by deep drawing techniques.

It will be understood that each of the elements described above, or two or more together, may also find a useful application in other types of constructions differing from the types described above.

While the invention has been illustrated and described as embodied in an arrangement for displaying articles, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. Arrangement for displaying articles, comprising a plurality of stackable elements, each having opposite sides; means for stacking said elements in a row, including a projection having an axis and extending lengthwise of said row beyond one of said sides of each of said elements, each projection having a free end portion which is elongated transversely of said row in a first direction and substantially coaxial with said projection, and a recess formed in the other of said sides of each of said elements substantially coaxial with said free end portion and being elongated transversely of said row in a different second direction, each recess of a respective element being operative for receiving said free end portions of a respective other element upon alignment of said respective free end portion in said second direction, and for maintaining successively stacked elements at a predetermined spacing from each other; and means for nesting said elements, including a cavity formed in said other side of each of said elements substantially coaxial with said recess and being elongated transversely of said row in said first direction, each cavity of a respective element being operative for receiving a respective projection upon insertion of the latter into said respective cavity, and for maintaining successively nested elements at a distance which is relatively smaller than the afore-mentioned predetermined spacing of said stacked elements, so that said elements can be moved by rotation about said axis between a stacked position when the free end portion of one of said elements is received in the recess of the other element, and a nested position when the projection of one of said elements is received in the cavity of the other element.

2. Arrangement as defined in claim 1; and further comprising means on said one side of each of said elements for mounting articles to be displayed.

3. Arrangement as defined in claim 2, wherein each element has a generally annular base portion, and wherein said mounting means includes a plurality of pockets spaced in circumferential direction about said base portion.

4. Arrangement as defined in claim 1, wherein each projection has a generally truncated pyramidal configuration, and wherein each recess has a complementary contour of such depth as to receive only a fractional part of the respective projection.

5. Arrangement as defined in claim 4, wherein said free end portions have a shoulder for abutment with a respective other side of said other element.

6. Arrangement as defined in claim 1, wherein said free end portions extend generally normally of said recess.

7. Arrangement as defined in claim 1, wherein each projection has a generally truncated pyramidal configuration; and wherein each cavity has a complementary contour of such depth as to receive a major fractional part of the respective projection.

8. Arrangement as defined in claim 1; each element further comprising a plurality of through holes extending to said opposite sides, first ones of said holes being located on said projections, and second ones of said holes being located on said recesses for juxtaposition with said first holes upon alignment of said respective free end portions in said second direction; and further comprising reinforcing pins extending through respectively justaposed holes for maintaining the elements in their stacked orientation.

9. Arrangement as defined in claim 13; and further comprising a mounting aperture extending to opposite sides of each of said elements, said aperture being operative for receiving an elongated support.

10. Arrangement as defined in claim 9, wherein said support is turnable; and further comprising means for mounting at least one of said elements on said support so that any article located on said one element is viewable by turning said support, said mounting means comprising a plate fixedly mounted on said support, and a depression for receiving said plate formed in a side of said one element which is opposite to the side for receiving articles to be displayed.

* * * * *